US005813602A

United States Patent [19]

Holland

[11] Patent Number: 5,813,602

[45] Date of Patent: Sep. 29, 1998

[54] SECURING EDGE PROTECTORS FOR CONCRETE GRADE CROSSING PANELS HAVING INTEGRAL ELASTOMERIC SEALS

[75] Inventor: Bryan L. Holland, Tualatin, Oreg.

[73] Assignee: Omni Products, Inc., Portland, Oreg.

[21] Appl. No.: 887,890

[22] Filed: Jul. 3, 1997

[51] Int. Cl.[6] ..... E01C 9/04

[52] U.S. Cl. ..... 238/8

[58] Field of Search ..... 238/8, 7

[56] References Cited

U.S. PATENT DOCUMENTS

| | | | |
|---|---|---|---|
| 2,950,057 | 8/1960 | Speer | 238/8 |
| 3,353,747 | 11/1967 | Speer | 238/8 |
| 3,825,184 | 7/1974 | Hartl | 238/8 |
| 4,236,670 | 12/1980 | Limmergard et al. | 238/8 |
| 4,372,488 | 2/1983 | Schönthaler et al. | 238/8 |
| 4,793,545 | 12/1988 | Raymond | 238/8 |
| 4,899,933 | 2/1990 | Martin | 238/8 |
| 5,181,657 | 1/1993 | Davis | 238/8 |
| 5,535,948 | 7/1996 | Williams | 238/8 |

FOREIGN PATENT DOCUMENTS

| | | | |
|---|---|---|---|
| 1012628 | 7/1957 | Germany | 238/8 |
| 1908832 | 1/1971 | Germany . | |
| 2350759 | 4/1975 | Germany . | |
| 2001985 | 10/1993 | Russian Federation | 238/8 |

OTHER PUBLICATIONS

"American Quality: We Go Beyond What's Expected, American Concrete Grade Crossings", article, American Concrete, at least as early as Apr. 11, 1997, 1 page.

"American Concrete Grade Crossing Specifications", article, American Concrete Products Co., Omaha, NE, at least as early as Apr. 11, 1997, 1 page.

Dimension specifications information, Century Precast, Sulphur, LA, at least as early as Apr. 11, 1997, 1 page.

"Section Thru Crossing", drawing, Magnum Manufacturing Corporation, Pleasant Grove, Utah, at least as early as Apr. 11, 1997, 1 page.

"Technical Information on Precast Crossing Panels, Installation Instructions of Precast Crossing Panels", article, Magnum Manufacturing Corporation, Pleasant Grove, Utah, at least as early as Apr. 11, 1997, 1 page.

*Primary Examiner*—S. Joseph Morano

*Attorney, Agent, or Firm*—Chernoff, Vilhauer, McClung & Stenzel, LLP

[57] ABSTRACT

In a system that extends a paved roadway across a pair of parallel, spaced apart rails using a gauge panel between the pair of rails and a pair of field panels between each rail and the roadway, edge protectors of the present invention are used to protect the edges of the panels. A seal is positioned between each rail and a longitudinal rail edge. In one embodiment, a longitudinal rail edge protector has a surface leg that is substantially even with the top surface of the panel and a securing leg that secures the seal to the panel either by being embedded in the seal or by covering or overlapping the seal. In an alternate embodiment, a longitudinal rail edge protector has a surface leg, a securing leg, and a securing extension that is embedded into the seal to secure the seal to the panel. In another alternate embodiment, the securing edge protector is flat and is embedded into the seal to secure the seal to the panel. Anchors may be used to attach the longitudinal rail edge protector to the panel. A longitudinal roadway edge may be protected by a longitudinal roadway edge protector that has a surface leg substantially even with the top surface of the panel. Each transverse edge of each panel may be protected by a transverse edge protector that has a surface leg substantially even with the top surface of the panel.

20 Claims, 5 Drawing Sheets

SECURING EDGE PROTECTORS FOR CONCRETE GRADE CROSSING PANELS HAVING INTEGRAL ELASTOMERIC SEALS

BACKGROUND OF THE INVENTION

This invention relates to railroad grade crossings incorporating precast concrete panels with elastomeric seals between the panels and rails, and in particular to railroad grade crossings using edge protectors for protecting the concrete and securing the seals.

When a railroad track crosses a roadway it is necessary to bring the space between the roadway and the rails, and the space between the rails, up to grade. This is accomplished by installing grade crossing elements into these spaces. In busy city streets it has become common to use precast concrete panels for this purpose. Concrete panels generally wear well and, therefore, withstand the heavy traffic occurring on busy city streets. In addition, precast concrete panels are quickly installed which reduces the time the street is unavailable during installation of the crossing. Finally, precast concrete panels are easily and quickly removed to access the track for repairs and maintenance.

When precast concrete crossing panels are used it is desirable to place elastomeric seals between the panels and the rails. These seals can provide a positive flangeway which prevents water from getting beneath the panels and weakening the ballast. The seals also create a cushioning transition between the rails and the concrete panels, which makes for a smoother ride for vehicles crossing the tracks and prevents chipping of the edges of the panels. The seals also reduce the transmission of vibration from the rails to the panels. Finally, elastomeric seals electrically isolate the rails from the panels. Despite the benefits of using elastomeric seals with precast concrete grade crossing panels, the elastomeric seals tend to separate from the concrete. Precast concrete grade crossing panels with elastomeric seals are shown, for example, in Williams U.S. Pat. No. 5,535,948, which is assigned to the assignee of this application and incorporated herein. Other examples of precast concrete grade crossing panels with elastomeric seals are shown in Davis U.S. Pat. No. 5,181,657 and Martin U.S. Pat. No. 4,899,933.

A problem with precast concrete grade crossing panels in general is that the edges of the concrete panels tend to chip or break off. This is true of the longitudinal edges bordered by the road, the transverse edges bordered by other concrete panels, and the longitudinal edges adjacent to the roadway or spaced from the rails. This problem has been solved in the past by placing edge protectors around the periphery of the panels. However, these known edge protectors are specifically directed to protecting the edges of the concrete panels.

SUMMARY OF THE PRESENT INVENTION

The present invention offers solutions to the problem of the elastomeric seals pulling out of the concrete panels by embedding edge protectors or extensions of edge protectors into the elastomeric seals. These solutions also tend to reduce or eliminate the problem of the chipping of the edges of the concrete panels. The edge protectors also tend to add structural integrity to the panels.

The present invention is used in a system that extends a roadway across a pair of parallel, spaced apart rails using a gauge panel between the pair of rails and a pair of field panels between each rail and the roadway. Each panel has two longitudinal edges and two transverse edges.

A seal may be used between the rail and a longitudinal "rail" edge that is adjacent to the rail. The present invention uses at least one securing longitudinal rail edge protector for protecting the longitudinal rail edge. Specifically, the securing edge protector has a surface leg that is substantially even with the top surface of the panel and a securing leg that secures the seal to the panel either by being embedded in the seal or covering or overlapping the seal. Anchors may be used to attach the securing edge protector to the panel.

An alternate securing edge protector has a surface leg, a securing leg, and an extension. The extension secures the seal to the panel as it is embedded in the side of the seal. Another embodiment of the invention is a flat securing edge protector that secures the seal to the panel as it is embedded in the seal.

Field panels also have a longitudinal "roadway" edge that is adjacent to a roadway. The longitudinal roadway edge may be protected by a longitudinal roadway edge protector that has a leg substantially even with a top surface of the panel.

Each transverse edge of each panel may be protected by a transverse edge protector that has a leg substantially even with a top surface of the panel. Optionally, the transverse edge protector may include a non-conductive spacer or may have a gap defined therein.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
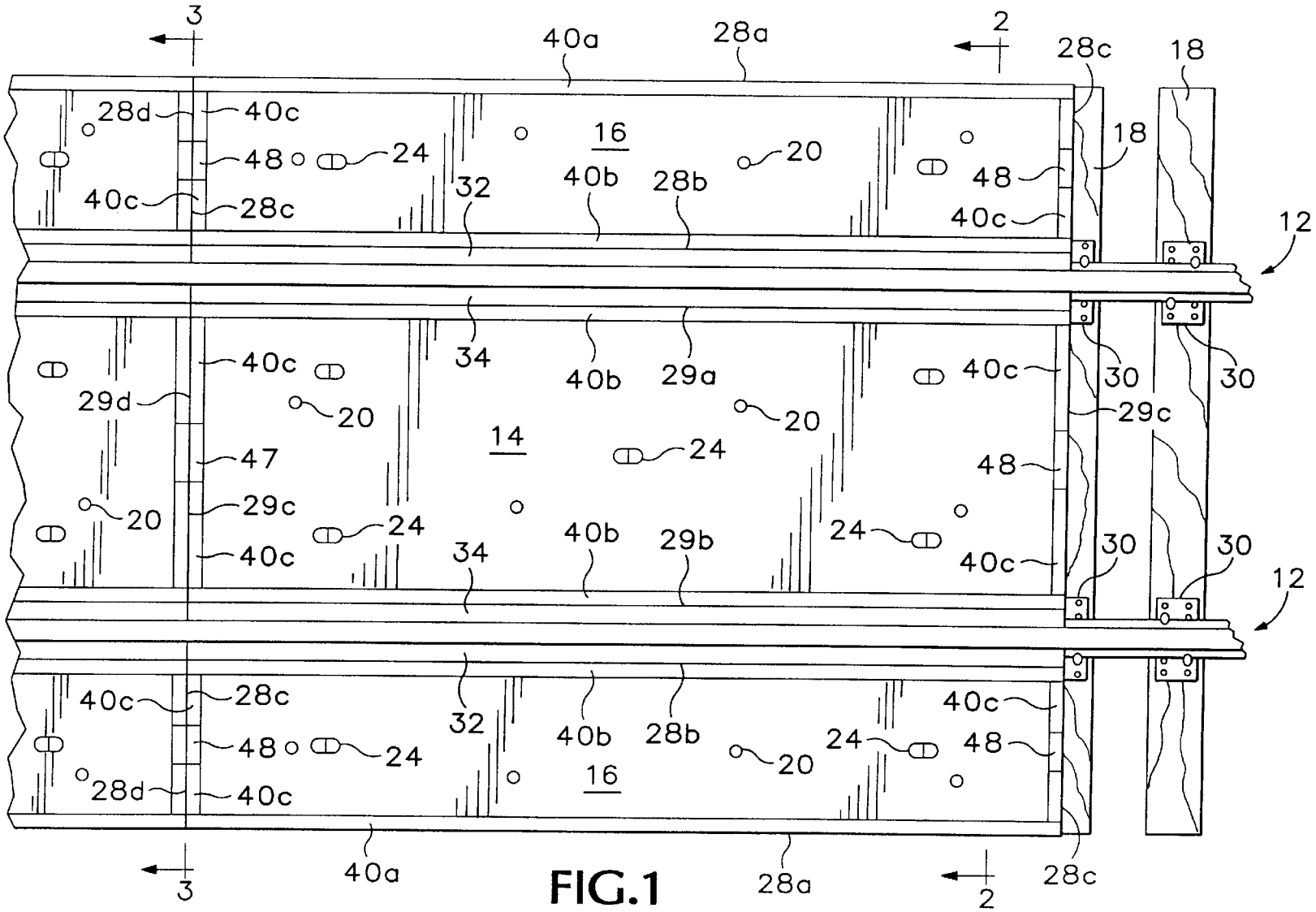
FIG. 1 is a fragmentary plan view, partially broken away, of a railroad grade crossing embodying the subject invention.

Referring to the drawings, when a railroad track crosses a roadway (not shown), a grade crossing must be installed that fills the open spaces between the roadway and the rails 12 and the open spaces between the pair of rails 12. The present invention accomplishes this by placing a precast concrete gauge panel 14 between the rails 12, and precast concrete field panels 16 between each rail 12 and the edge of the roadway (not shown). Precast concrete grade crossing panels 14, 16 in general are well known in the prior art, and are shown in Davis U.S. Pat. No. 5,181,657 and Martin U.S. Pat. No. 4,899,933.

Precast concrete grade crossing panels 14, 16 rest on the timber or concrete ties 18 that support the rails, and are held in place in the conventional manner. The panels 14, 16 have a thickness which makes their top surfaces coplanar with the roadway and with the tops of the rails 12. The embodiment shown in the drawings have optional counterbored holes 20 in the panels 14, 16 through which screws 22 (shown in phantom in FIG. 2) may be inserted to secure the panels 14, 16 to the ties 18. The panels 14, 16 also may have lifting eye pockets 24 placed in them to receive lifting hooks (not shown) to facilitate lifting the panels 14, 16 when they are being installed or removed. As shown, the panels 14, 16, are reinforced with metal reinforcement bars 26 ("rebar") or wire mesh (not shown) in the concrete 27. The bars 26 are used to give the panels 14, 16 a greater tensile strength.

Each panel 14, 16 has four edges: two longitudinal edges and two transverse edges. Specifically, each field panel 16 has a longitudinal roadway edge 28*a* that abuts the roadway (although an expansion joint may be inserted between the edge 28*a* and the roadway), a longitudinal rail edge 28*b* that is in a parallel spaced relationship with one of the rails 12, and two transverse edges 28*c*, 28*d* that abut the transverse edges of adjacent field panels 16. The gauge panels 14 have two longitudinal rail edges 29*a*, 29*b* each of which are in a parallel spaced relationship with one of the rails 12 and two transverse edges 29*c*, 29*d* that abut the transverse edges of adjacent gauge panels 14. The longitudinal edges 28*b*, 29*a*, 29*b* adjacent the rail 12 are preferably undercut to fit over the rail fasteners 30 (such as the plates and rail spikes) that are used to attach the rails 12 to the ties 18.

Figure 2:
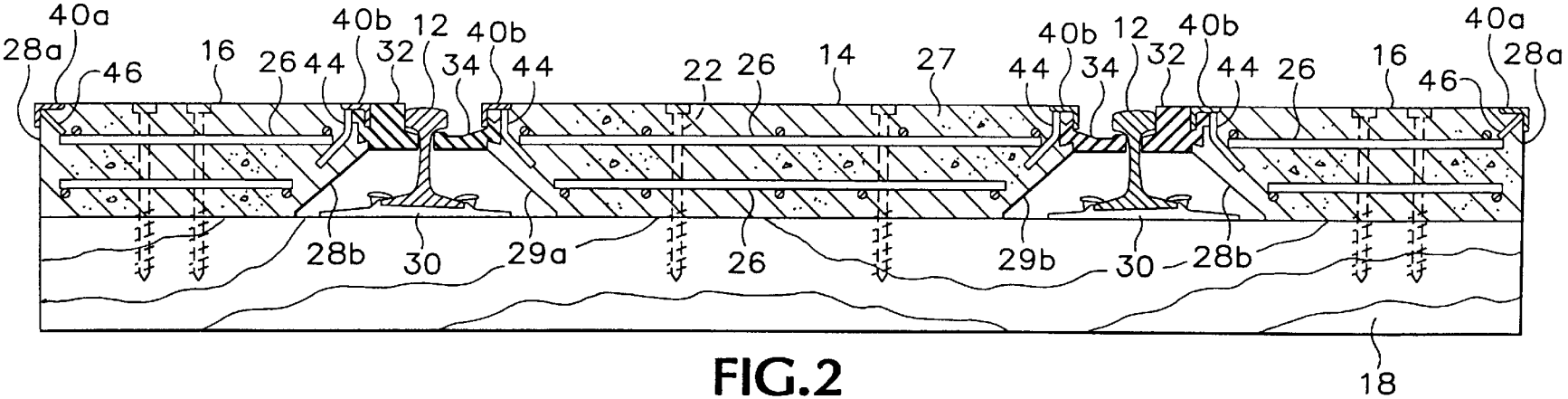
FIG. 2 is a sectional view taken along line 2—2 in FIG. 1.

Williams U.S. Pat. No. 5,535,948, which is assigned to the assignee of this application and incorporated herein, discusses specifics of elastomeric field seals and elastomeric gauge seals. Generally, as shown in FIG. 2, a field seal 32 is set between the longitudinal rail edge 28*b* of the field panel 16 and the rails 12. Further, as shown in FIG. 2, a gauge seal 34 is set between each longitudinal rail edge 29*a*, 29*b* of the gauge panel 14 and a rail 12.

The embodiments shown in FIGS. 1–5 use L-shaped edge protectors (40*b*, in FIGS. 1–4 and 40' in FIG. 5) along the edges of the concrete panels 14, 16 to protect the edges from chipping or breaking. As shown in detail in FIGS. 4*a*–4*d*, each securing edge protector, 40*b* has a surface leg 41*a* and a securing leg 41*b*. Each surface leg 41*a* is substantially even with a top surface of a respective adjacent panel 14, 16. Each securing leg 41*b* is either embedded in a respective seal 32, 34 or covers or overlaps a respective seal 32, 34. Further, because the securing edge protectors 40*b* cover or are embedded in the elastomeric seals 32, 34, the edge protectors 40*b* securely hold the seals in place.

Figure 4A:
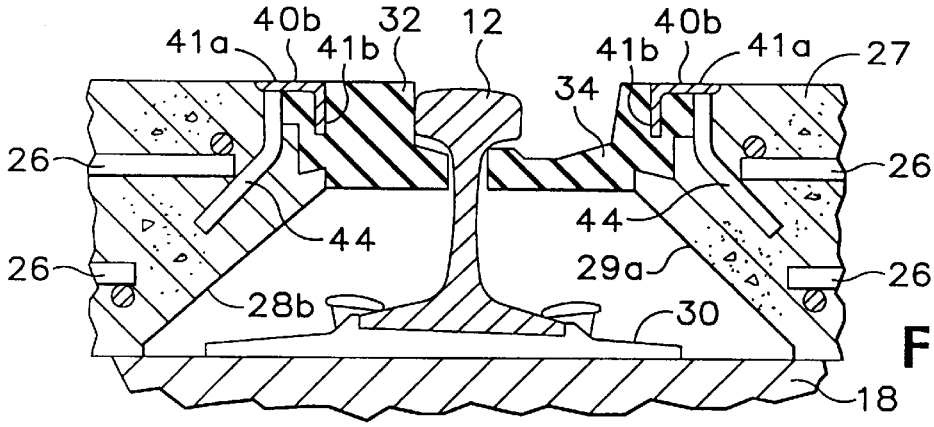
FIGS. 4*a*–4*d* are detailed views, at an enlarged scale, showing how the securing longitudinal rail edge protectors and seals are set in the concrete panels and interact with the rails.
Figure 4B:
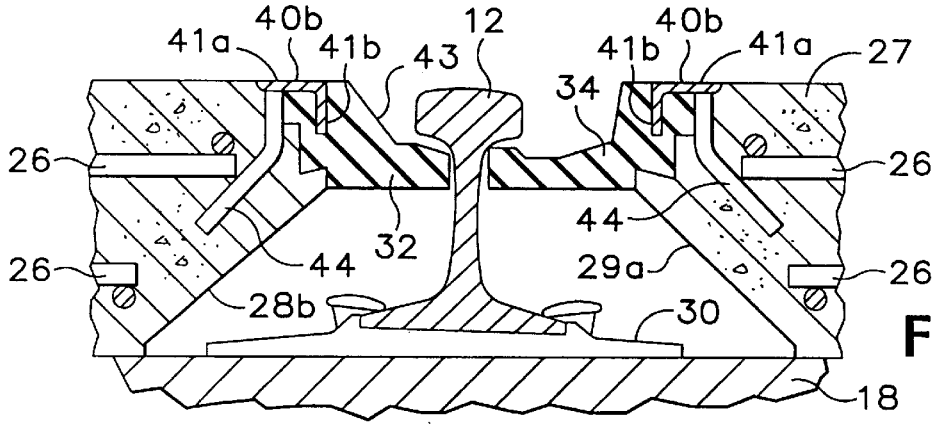
Figure 4C:
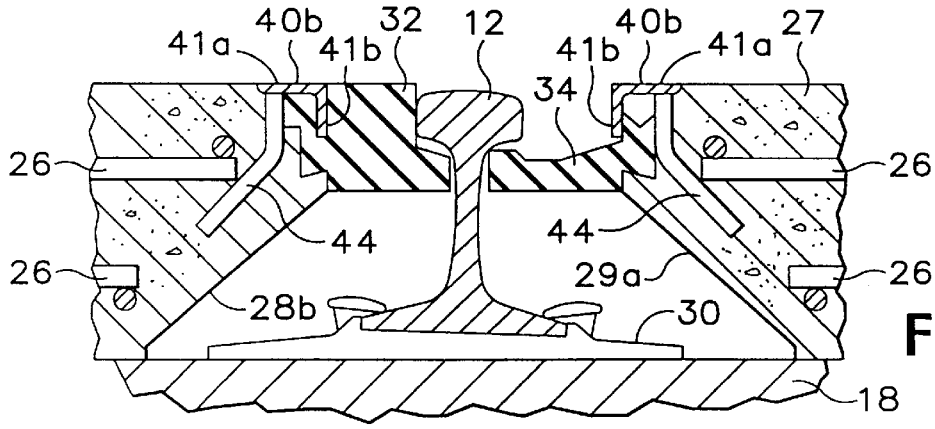
Figure 4D:
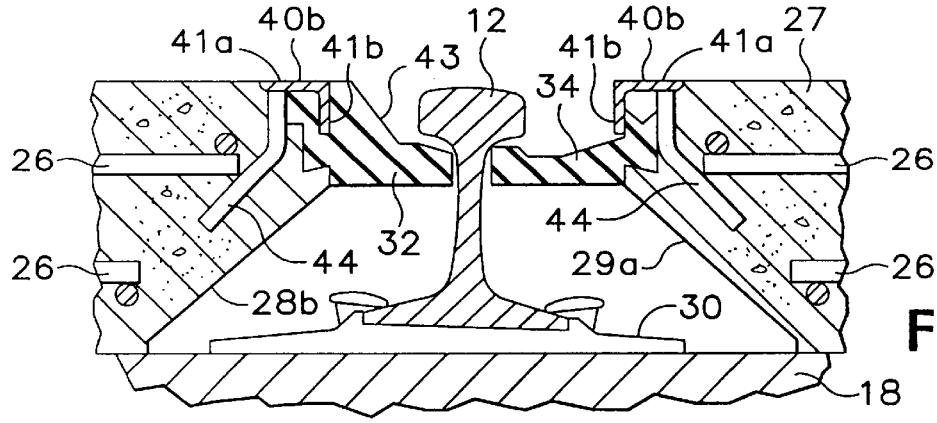
Figure 5:
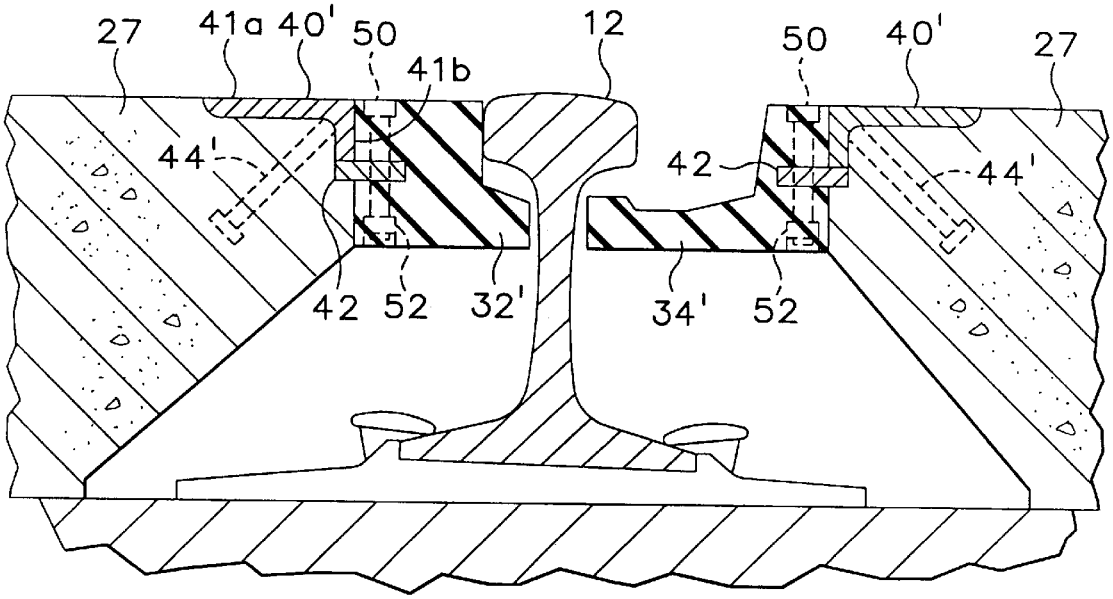
FIG. 5 is a cross sectional view of an embodiment of the present invention embedding extensions of the edge protectors into the seals.

The embodiment shown in FIG. 5 also uses a L-shaped edge protector 40'. However, the edge protector 40' is augmented by an extension 42 that is embedded into the sides of the seals 32', 34'. The extension 42 serves the securing purpose of the securing leg 41*b* of the other L-shaped embodiments. The embodiment shown in FIGS. 6*a* and 6*b* uses a flat edge protector 40" that is embedded into seals 32", 34" to secure the seals. The flat edge protector 40" is mostly designed to serve the securing purpose of the securing leg 41*b* or extension 42 of the L-shaped embodiments. Most of the discussion below directed to the embodiment shown in FIGS. 1–4*d* applies equally to the embodiments of FIGS. 5, 6*a*, and 6*b*. However, some variations (such as notches or slots molded into the seals 32", 34") exist between the embodiments and the creation of the different embodiments varies, as will be discussed below.

Figure 3:
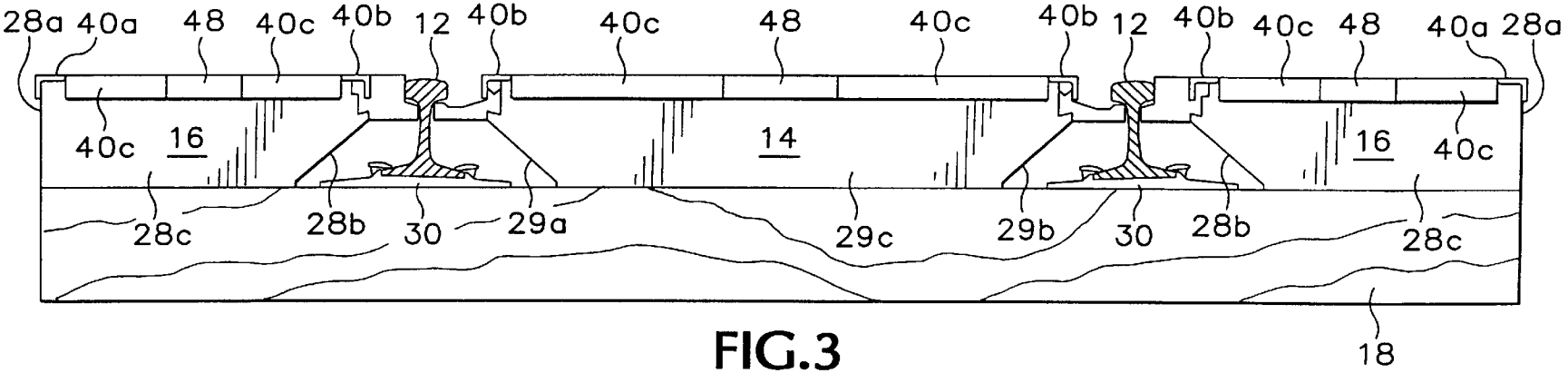
FIG. 3 is a sectional view taken along line 3—3 in FIG. 1.

FIGS. 2 and 3 show longitudinal roadway edge protectors 40*a* that cover the longitudinal roadway edges 28*a* of the field panels 16. As shown, the top surface of each edge 28*a* of each panel 16 has an indent therein so that the surface leg 41*a* of the roadway edge protector 40*a* is even with the top surface of the panel 16. The side surface of each edge 28*a* of each panel 16 may or may not have a similar indention. Preferably, the roadway edge protectors 40*a* protect the full length of the longitudinal roadway edges 28*a*.

FIGS. 2 and 3 also show the securing edge protectors 40*b* that protect the longitudinal rail edges 28*b* of the field panel 16 and the two longitudinal rail edges 29*a*, 29*b* of the gauge panels 14. The top surface of each edge 28*a* of each panel 16 has an indentation so that the surface leg 41*a* of each rail edge protector 40*b* is even with the top surface of the panel 16. Preferably, the rail edge protectors 40*b* protect the full length of the longitudinal rail edges 28*b*, 29*a*, 29*b*.

FIGS. 4*a*–4*d* show several embodiments of the interconnection between the longitudinal rail edges 28*b* and 29*a*, the rail edge protectors 40*b*, the elastomeric seals 32, 34, and a rail 12. It should be noted that the configuration for the opposite rail 12 that is surrounded by the longitudinal rail edges 28*b* and 29*b* would be the mirror image of that shown in the figures.

FIGS. 4*a* and 4*b* show a configuration in which the securing legs 41*b* of both rail edge protectors 40*b* are embedded into the respective seals 32, 34. FIG. 4*a* shows a field seal 32 that does not have a relief in combination with a gauge seal 34 that has a flangeway relief that allows the train wheel to interact with the rail 12 without interference. FIG. 4*b* shows a field seal 32 that has a grind relief 43 in combination with a gauge seal 34 that has a flangeway relief. The grind relief 43 allows maintenance to be done on the rails 12 without interference. It should be noted that an embodiment using covering securing legs 41*b* on both sides could also be used.

FIGS. 4*c* and 4*d* show a configuration in which the securing leg 41*b* of one rail edge protector 40*b* is embedded in seal 32 and the other securing leg 41*b* of the rail edge protector 40*b* covers or overlaps seal 34. FIG. 4*c* shows this embodiment with a field seal 32 without a relief in combination with a gauge seal 34 that has a flangeway relief. FIG. 4*d* shows this embodiment with a field seal 32 with a grind relief 43 in combination with a gauge seal 34 with a flangeway relief.

As shown in FIGS. 2 and 4*a*–4*d*, anchors 44, 46 may be used to secure the roadway and rail edge protectors 40*a*, 40*b* to the longitudinal edges 28*a*, 28*b*, 29*a*, 29*b* of the panels 14, 16. The anchors 44, 46 are preferably welded or otherwise secured to the surface leg 41*a* of the longitudinal edge protectors 40*a*, 40*b* prior to the concrete being cast around the framework (including the edge protectors 40*a*, 40*b*, 40*c*, reinforcement bars 26, and anchors 44, 46). Also as mentioned above, the panels 14, 16, are reinforced with metal reinforcement bars 26. Although the anchors 44, 46 may be welded to the reinforcement bars 26 for strength and ease of handling, when rails are used to carry signals the anchors 44, 46 are generally not welded to the reinforcement bars 26. The anchors 44, 46 may be of any suitable form including, but not limited to, the shown J-shaped anchors 44 and the shown substantially diagonally situated corner anchors 46 (such as the commonly used "stud" anchor). Also, preferably the anchors 44, 46 are placed at spaced intervals along the longitudinal and transverse edges 28*a*, 28*b*, 28*c*, 29*a*, 29*b*, 29*c*.

As mentioned above, each field panel 16 has two transverse edges 28*c*, 28*d* that abut the transverse edges of adjacent field panels 16 and each gauge panel 14 has two transverse edges 29*c*, 29*d* that abut the transverse edges of adjacent gauge panels 14. The transverse edges 28*c*, 28*d*, 29*c*, 29*d* may be protected by transverse edge protectors 40*c*. As shown on FIGS. 1 and 3, the transverse edge protectors 40*c* on the transverse edges 28*c*, 28*d*, 29*c*, 29*d* extend only between the surface legs 41*a* of the longitudinal edge protectors 40*a*, 40*b* on the longitudinal edges 28*a*, 28*b*, 29*a*, 29*b*. This prevents the longitudinal edge protectors 40*a*, 40*b* from overlapping with the edge protectors 40*c*. Alternatively, other embodiments (not shown) may use overlapping edge protectors.

Also, because the edge protectors 40*a*, 40*b*, 40*c* are generally metal, to prevent signal shunting it is preferable to allow for either a gap 47 (FIG. 1) or a plastic (or other non-conductive sturdy material) spacer 48 in the transverse edge protectors 40*b*. This prevents rail or signal shunting. Also, although the edge protectors 40*a*–40*c* are generally metal, they also be made of any suitably durable material.

It should also be noted that the elastomeric seals 32, 34 may or may not be flush against the rails 12 and therefore may or may not necessarily function as a traditional water tight seal.

The embodiment shown in FIGS. 4*a*–4*d* may be created by performing the following steps: the anchors 44, 46 are first spot-welded onto their respective edge protectors 40*a*, 40*b*, 40*c*; next, the edge protectors 40*a*, 40*b*, 40*c* may then be assembled into a frame; a two-layer rebar reinforcement cage is assembled using the rebar 26 (which may have one or more spacing bars therebetween); the rebar reinforcement cage, edge protectors 40*a*, 40*b*, 40*c*, and seals 32, 34 may then be assembled within a casting form; next, concrete 27 is poured into the casting form; finally, when the concrete 27 is dry, the concrete panel is removed from the casting form and it comes out as an integral concrete panel with edge protectors 40*a*, 40*b*, 40*c*. It should be noted that these steps are approximate and that some changes in order are anticipated. (For example, the rebar reinforcement cage may be assembled prior to spot welding the anchors 44, 46 onto the edge protectors 40*a*, 40*b*, 40*c*.)

The embodiment shown in FIG. 5 may be created by performing the following steps: anchors 44' are first spot-welded onto the edge protectors 40'; next, the extensions 42 are welded onto the edge protectors 40'; the edge protectors 40' may then be assembled into a frame; a two-layer rebar reinforcement cage is then assembled using the rebar 26 (shown in FIGS. 2 and 4*a*–4*d*) (which may have one or more spacing bars therebetween); the rebar reinforcement cage and edge protectors 40' may then be assembled within a casting form; next, concrete 27 is poured into the casting form; when the concrete 27 is dry, the concrete panel is removed from the casting form; the seals 32', 34' may then be positioned around the extensions 42; a bolt 50 may then inserted through the seals 32', 34" and the extension 42; and finally the bolt 50 is tightened using, for example, a nut 52. It should be noted that these steps are approximate and that some changes in order are anticipated. (For example, the rebar reinforcement cage may be assembled prior to spot welding the anchors 44' onto the edge protectors 40'.)

Figure 6B:
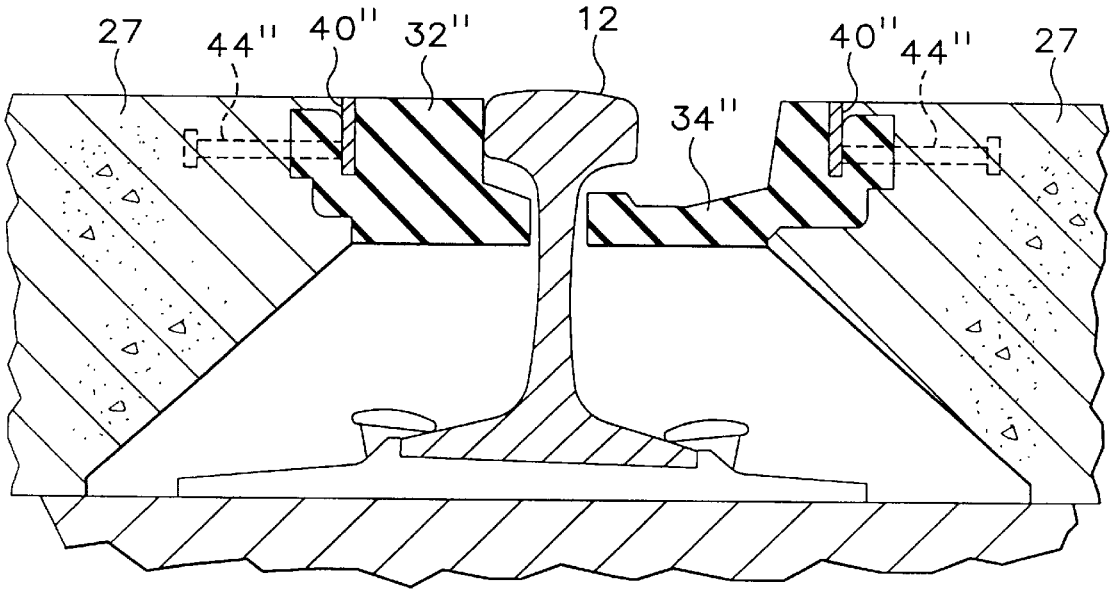
FIG. 6*b* is a cross sectional view of the embodiment of FIG. 6*a*.
Figure 6A:
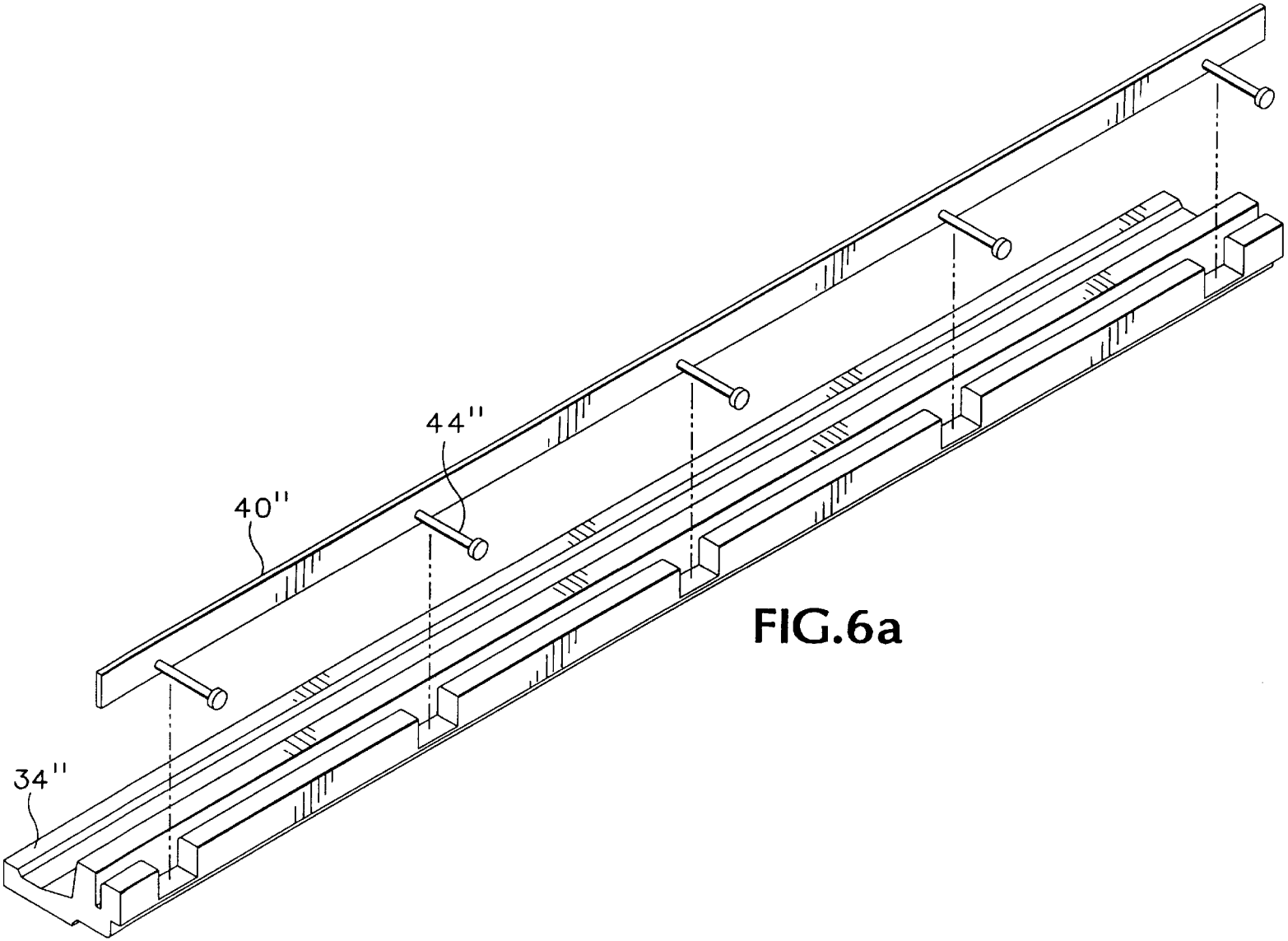
FIG. 6*a* is an expanded perspective view of an embodiment of the present invention using flat edge protectors.

The embodiment shown in FIGS. 6*a* and 6*b* may be created by performing the following steps: the anchors 44" are first spot-welded onto the edge protectors 40"; the edge protectors 40" may then be assembled into a frame; a two-layer rebar reinforcement cage is then assembled using the rebar 26 (shown in FIGS. 2 and 4*a*–4*d*) (which may have one or more spacing bars therebetween); the rebar reinforcement cage, edge protectors 40", and seals 32", 34" may then be assembled within a casting form; next, concrete 27 is poured into the casting form; when the concrete 27 is dry, the concrete panel is removed from the casting form and the resulting panel is an integral unit with the seals 32", 34". It should be noted that these steps are approximate and that some changes in order are anticipated.

It should also be noted that only a small portion of this embodiments of FIGS. 5 and 6*a*–6*b* are shown. Accordingly, other features may be implied or deduced from the discussion of the other embodiments. For example, if transverse edge protectors are used, they may be L-shaped, L-shaped with extensions, or flat.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A railroad grade crossing for extending a roadway across a pair of parallel, spaced apart rails, comprising:

(a) at least one concrete panel having at least one longitudinal rail edge adjacent and parallel to at least one of said rails;

(b) at least one elastomeric seal parallel to said at least one longitudinal rail edge, said at least one seal positioned between one of said rails and said at least one longitudinal rail edge;

(c) at least one securing edge protector protecting said at least one longitudinal rail edge and simultaneously securing the respective seal in the respective panel;

(d) said at least one securing edge protector having a surface leg and a securing leg; and (e) said securing leg overlapping at least part of an upper surface of a respective seal.

2. The railroad grade crossing of claim 1:

(a) said at least one concrete panel being a concrete gauge panel and a pair of concrete field panels:

(i) said concrete gauge panel extending substantially between said rails and having two gauge longitudinal rail edges and two gauge transverse edges; and (ii) said concrete field panels each extending substantially between one of said rails and the roadway, each field panel having a field longitudinal rail edge, a field longitudinal roadway edge, and two field transverse edges;

(b) said at least one elastomeric seal being at least one gauge elastomeric seal and at least one field elastomeric seal:

(i) said at least one gauge elastomeric seal being parallel to one of said gauge longitudinal rail edges and positioned between one of said rails and one of said gauge longitudinal rail edges; and (i) said at least one field elastomeric seal being parallel to one of said field longitudinal rail edges and positioned between one of said rails and one of said field longitudinal rail edges; and (c) said at least one securing edge protector being at least one gauge edge protector and at least one field edge protector:

(i) said at least one gauge edge protector protecting at least one of said gauge longitudinal rail edges and simultaneously securing the respective gauge elastomeric seal in the adjacent gauge panel; and (ii) said at least one field edge protector protecting at least one of said field longitudinal rail edges and simultaneously securing the respective field elastomeric seal in the adjacent field panel.

3. The railroad grade crossing of claim 2 further comprising:

(a) at least one longitudinal roadway edge protector for protecting at least one said field longitudinal roadway edge; and (b) each said longitudinal roadway edge protector having a surface leg substantially even with a top surface of the respective panel.

4. The railroad grade crossing of claim 2, further comprising:

(a) at least one transverse edge protector for protecting at least one said transverse edge; and (b) said transverse edge protector having a surface leg substantially even with a top surface of the respective panel.

5. The railroad grade crossing of claim 4 wherein said at least one transverse edge protector includes a non-conductive spacer.

6. The railroad grade crossing of claim 5 wherein said at least one transverse edge protector has two parts defining a gap.

7. The railroad grade crossing of claim 1 wherein said surface leg is substantially even with a top surface of the respective concrete panel.

8. The railroad grade crossing of claim 1, further comprising at least one anchor attached to said securing edge protector.

9. A railroad grade crossing for extending a roadway across a pair of parallel, spaced apart rails, said railroad grade crossing incorporating panels and seals between the pair of rails and between each rail and the roadway, each panel having two longitudinal edges and two transverse edges, said railroad grade crossing comprising:

(a) at least one longitudinal rail edge protector for protecting a longitudinal rail edge of at least one of said panels adjacent at least one of said rails, the longitudinal rail edge protector having a surface leg and a securing leg;

(b) said surface leg substantially even with a top surface of said panel;

(c) said securing leg securing a seal to said panel; and (d) said securing leg being embedded in said seal.

10. The railroad grade crossing of claim 9 further comprising at least one anchor attached to said longitudinal rail edge protector and embedded in said panel.

11. The railroad grade crossing of claim 9 further comprising:

(a) at least one longitudinal roadway edge protector for protecting a longitudinal roadway edge of at least one of said panels adjacent the roadway; and (b) said longitudinal roadway edge protector having a surface leg substantially even with a top surface of said panel.

12. The railroad grade crossing of claim 9 further comprising:

(a) at least one transverse edge-protector for protecting a transverse edge of at least one of said panels; and (b) said transverse edge protector having a surface leg substantially even with a top surface of said panel.

13. The railroad grade crossing of claim 12 wherein said at least one transverse edge protector includes a non-conductive spacer.

14. The railroad grade crossing of claim 12 wherein said at least one transverse edge protector has two parts that define a gap.

15. A railroad grade crossing for extending a roadway across a pair of parallel, spaced apart rails, comprising:

(a) at least one concrete panel having at least one longitudinal rail edge adjacent and parallel to at least one of said rails;

(b) at least one elastomeric seal parallel to said at least one longitudinal rail edge, said at least one seal positioned between one of the rails and said at least one longitudinal rail edge; and (c) at least one securing edge protector embedded in said at least one seal to secure said at least one seal to a respective panel.

16. The railroad grade crossing of claim 15:

(a) said at least one concrete panel being a concrete gauge panel and a pair of concrete field panels:

(i) said concrete gauge panel extending substantially between said rails and having two gauge longitudinal rail edges and two gauge transverse edges; and (ii) said concrete field panels each extending substantially between one of said rails and the roadway, each field panel having a field longitudinal rail edge, a field longitudinal roadway edge, and two field transverse edges;

(b) said at least one elastomeric seal being at least one gauge elastomeric seal and at least one field elastomeric seal:

(i) said at least one gauge elastomeric seal being parallel to one of said gauge longitudinal rail edges and positioned between one of said rails and one of said gauge longitudinal rail edges; and (i) said at least one field elastomeric seal being parallel to one of said field longitudinal rail edges and positioned between one of said rails and one of said field longitudinal rail edges; and (c) said at least one securing edge protector being at least one gauge edge protector and at least one field edge protector:

(i) said at least one gauge edge protector protecting at least one of said gauge longitudinal rail edges and simultaneously securing the respective gauge elastomeric seal in the adjacent gauge panel; and (ii) said at least one field edge protector protecting at least one of said field longitudinal rail edges and simultaneously securing the respective field elastomeric seal in the adjacent field panel.

17. The railroad grade crossing of claim 15, further comprising at least one anchor attached to said securing edge protector.

18. A railroad grade crossing for extending a roadway across a pair of parallel, spaced apart rails, comprising:

(a) at least one concrete panel having at least one longitudinal rail edge adjacent and parallel to at least one of said rails;

(b) at least one elastomeric seal parallel to said at least one longitudinal rail edge, said at least one seal positioned between one of said rails and said at least one longitudinal rail edge;

(c) at least one securing edge protector protecting said at least one longitudinal rail edge and simultaneously securing the respective seal in the respective panel;

(d) said at least one securing edge protector having a surface leg and a securing leg; and (e) said securing leg being embedded in a respective seal.

19. A railroad grade crossing for extending a roadway across a pair of parallel, spaced apart rails, comprising:

(a) at least one concrete panel having at least one longitudinal rail edge adjacent and parallel to at least one of said rails;

(b) at least one elastomeric seal parallel to said at least one longitudinal rail edge, said at least one seal positioned between one of said rails and said at least one longitudinal rail edge;

(c) at least one securing edge protector protecting said at least one longitudinal rail edge and simultaneously securing the respective seal in the respective panel;

(d) said at least one securing edge protector having a surface leg and a securing leg; and (e) said at least one securing edge protector having an extension leg attached to said securing leg, said extension leg embedded in said elastomeric seal.

20. A railroad grade crossing for extending a roadway across a pair of parallel, spaced apart rails, said railroad grade crossing incorporating panels and seals between the pair of rails and between each rail and the roadway, each panel having two longitudinal edges and two transverse edges, said railroad grade crossing comprising:

(a) at least one longitudinal rail edge protector for protecting a longitudinal rail edge of at least one of said panels adjacent at least one of said rails, the longitudinal rail edge protector having a surface leg and a securing leg;

(b) said surface leg substantially even with a top surface of said panel;

(c) said securing leg securing a seal to said panel; and (d) said securing leg overlapping at least part of an upper surface of said seal.

* * * * *